US005725977A

United States Patent [19]

Hojo et al.

[11] Patent Number: 5,725,977

[45] Date of Patent: Mar. 10, 1998

[54] METHOD OF FORMING FLUORESCENT SCREEN FOR COLOR CATHODE-RAY TUBE AND EXPOSURE SYSTEM FOR FORMING SAME

[75] Inventors: Minoru Hojo; Hiroo Kobayashi; Akira Inoue; Syunichi Igeta, all of Kyoto, Japan

[73] Assignee: Mitsubishi Denki Kabushiki Kaisha, Tokyo, Japan

[21] Appl. No.: 873,175

[22] Filed: Jun. 11, 1997

Related U.S. Application Data

[63] Continuation of Ser. No. 501,176, Jul. 11, 1995, abandoned.

[30] Foreign Application Priority Data

Jan. 18, 1995 [JP] Japan ..... 7-006012

[51] Int. Cl.[6] ..... H01J 9/227

[52] U.S. Cl. ..... 430/24; 430/22; 430/25; 430/26; 445/63

[58] Field of Search ..... 430/24, 23, 22, 430/25, 26, 27, 30; 445/68, 60, 63

[56] References Cited

U.S. PATENT DOCUMENTS

| | | | |
|---|---|---|---|
| 3,975,198 | 8/1976 | Palac et al. | 430/23 |
| 5,158,491 | 10/1992 | Fendley et al. | 430/24 |

FOREIGN PATENT DOCUMENTS

| | | |
|---|---|---|
| 58-186133 | 10/1983 | Japan . |
| 5-922349 | 5/1984 | Japan . |
| 61-6495 | 2/1986 | Japan . |
| 6-228538 | 6/1987 | Japan . |

*Primary Examiner*—John A. McPherson

[57] ABSTRACT

An exposure system including a master mask used for exposing a glass panel to form a plurality of phosphor stripes or dots on an inner surface of the glass panel wherein the master mask and/or a light source are movable for correction of an exposure position, thereby eliminating the need to attach and remove a color selecting mechanism to and from the glass panel when the glass panel is exposed to form a fluorescent screen on the inner surface of the glass panel.

27 Claims, 10 Drawing Sheets

METHOD OF FORMING FLUORESCENT SCREEN FOR COLOR CATHODE-RAY TUBE AND EXPOSURE SYSTEM FOR FORMING SAME

This application is a continuation of application Ser. No. 08/501,176 filed on Jul. 11, 1995, now abandoned.

BACKGROUND OF THE INVENTION

1. Field of the Invention

The present invention relates to a method of forming a fluorescent screen for a color cathode-ray tube and more particularly to improvements in efficiency and quality of a fluorescent screen for a color cathode-ray tube. The present invention also relates to an exposure system for forming a fluorescent screen for a color cathode-ray tube.

2. Description of the Background Art

FIG. 13 is a cross-sectional view of a conventional exposure system for use in forming a fluorescent screen for a color cathode-ray tube. In FIG. 13, the reference numeral 1 designates a box-like body for supporting constituent members of the exposure system; 2 designates a light source disposed in the box-like body 1 and including a mercury lamp; 3 designates a light intensity correction filter fixed in the box-like body 1 for adjusting the distribution of light quantity from the light source 2; 4 designates a first correction lens fixed in the box-like body 1 for correcting the optical path of an exposure light beam for correction of side beam landing; 5 designates a second correction lens fixed in the box-like body 1 for correcting the optical path of the exposure light beam for correction of beam landing; 6 designates a cover glass in an opening of the box-like body 1 for allowing light from the light source 2 to pass through and keeping dust out; 7 designates a glass panel to be exposed; 8 designates a support potion at the top of the box-like body 1 for supporting the glass panel 7; and 9 designates a color selecting mechanism (for example, shadow mask) in a one-to-one correspondence with the glass panel 7 and fitted on an inner surface of the glass panel 7. The first correction lens 4 and the second correction lens 5 form a lens system for optical path correction. The glass panel 7 is mounted on the front of the color cathode-ray tube. Although not shown in FIG. 13, the cover glass 6 is rotated by a drive to prevent an exposure failure due to dust.

A method of forming a fluorescent screen will be described below. A black matrix is formed first. The glass panel 7 is washed and dried to remove moisture on the surface thereof. For formation of a photoresist film, a photoresist material is applied to the glass panel 7 and is then dried. The photoresist on the glass panel 7 is exposed, with the color selecting mechanism 9 fitted on the inner surface the glass panel 7. For exposure, the glass panel 7 with the color selecting mechanism fitted therein is placed on the exposure system as shown in FIG. 13. The glass panel 7 is in a one-to-one correspondence with the color selecting mechanism 9. Light emitted from the light source 2 is subjected to light quantity distribution adjustment by the light intensity correction filter 3, and is then subjected to optical path correction by the lens system including the first correction lens 4 and the second correction lens 5. The light then passes through the cover glass 6 and slots or dots in the color selecting mechanism 9 to an inner surface of the glass panel 7 in position. After the exposure, the color selecting mechanism 9 is removed, and the photoresist film on the glass panel 7 is developed. A graphite film is formed on the glass panel 7 and etched. This completes the black matrix.

Then phosphor stripes or dots are formed. A fluorescent material for green is applied to the glass panel 7 with the black matrix formed thereon. The color selecting mechanism 9 is fitted on the inner surface of the glass panel 7, and the fluorescent material on the glass panel 7 is exposed and developed in the same manner as the formation of the black matrix. Similar operation is performed on fluorescent materials for blue and red. Then the glass panel 7 is coated with lacquer and subjected to aluminum deposition. This completes the formation of the fluorescent screen. It should be noted that the optical path correction in the exposure system is made by position change of the light source 2 and by the lens system including the first correction lens 4 and the second correction lens 5.

In the conventional method of forming the fluorescent screen for the color cathode-ray tube and the conventional exposure system for forming the same, the color selecting mechanism 9 is attached to and removed from the glass panel 7 each time the glass panel is exposed to form the phosphor layers and the black matrix layer. The color selecting mechanism 9 attached to and removed from the glass panel 7 deviates relative to the glass panel 7 to provide low reproducibility of the phosphor layers and black matrix layer to be formed, resulting in misaligned relationship between the black matrix and the phosphor layers, failures due to the attachment and removal of the color selecting mechanism 9, and operating time losses due to attachment and removal time. For example, fluorescent screens having a great amount of misalignment between the black matrix and the phosphor layers are disposed of as defective products, and those having a small amount of misalignment therebetween are required to be re-formed after removal of the black matrix and phosphor layers.

SUMMARY OF THE INVENTION

The present invention is intended for a method of forming a fluorescent screen for a color cathode-ray tube by forming a plurality of phosphor stripes or a plurality of phosphor dots on an inner surface of a panel of the color cathode-ray tube. According to a first aspect of the present invention, the method comprises the steps of: (a) adjusting a position of the plurality of stripes or a plurality of dots to be projected onto the panel through a position-adjustable master mask of an exposure system in order to form the plurality of stripes or dots in a predetermined position of the color cathode-ray tube; and (b) mounting the panel in the exposure system to expose the panel in order to form the plurality of phosphor stripes or dots.

Preferably, according to a second aspect of the present invention, the step (a) includes the step of adjusting the position of the plurality of stripes or dots for each of a plurality of first exposure systems, the plurality of first exposure systems including phosphor layer master masks of different configurations corresponding to different emitted colors of phosphor layers, respectively, and having the same construction except the phosphor layer master masks, the plurality of stripes or dots being to be projected onto the panel through the phosphor layer master masks of the plurality of first exposure systems; and the step (b) includes the step of sequentially mounting one panel in the plurality of first exposure systems to expose the panel by the plurality of first exposure systems.

Preferably, according to a third aspect of the present invention, the step (a) further includes the step of adjusting the position of the plurality of stripes or dots to be projected onto the panel through a black matrix master mask of a second exposure system, the second exposure system including the black matrix master mask and having the same construction as the first exposure systems except that the phosphor layer master masks of the plurality of first exposure systems and the black matrix master mask; and the step (b) further includes the step of mounting the panel in the second exposure system to expose the panel.

Preferably, according to a fourth aspect of the present invention, the master mask of the exposure system used in the steps (a) and (b) has a predetermined curvature.

Preferably, according to a fifth aspect of the present invention, the master mask of the exposure system used in the steps (a) and (b) has a flat major surface.

Preferably, according to a sixth aspect of the present invention, the master mask has a slot or dot array in a predetermined position of the exposure system used in the steps (a) and (b), and the slot or dot array is determined by a stripe or dot array to be projected onto the inner surface of the panel and the position of a light source of the exposure system.

Preferably, according to a seventh aspect of the present invention, the master mask has a slot or dot array in a predetermined position of the exposure system used in the steps (a) and (b), and the slot or dot array is determined by a stripe or dot array to be projected onto the inner surface of the panel through a slot or dot array of a color selecting mechanism in the color cathode-ray tube and the position of a light source of the exposure system.

Preferably, according to an eighth aspect of the present invention, the position adjustment of the plurality of phosphor stripes or dots to be projected onto the panel in the step (a) includes an adjustment by moving the master mask in a direction perpendicular to a major surface of the master mask, in a first direction within the major surface of the master mask, in a second direction within the major surface and orthogonal to the first direction, and a rotational direction within the major surface.

Preferably, according to a ninth aspect of the present invention, the position adjustment of the plurality of stripes or dots to be projected onto the panel in the step (a) includes an adjustment by moving a light source of the exposure system in a direction perpendicular to a major surface of the master mask, in a first direction parallel to the major surface of the master mask, and in a second direction parallel to the major surface and orthogonal to the first direction.

Preferably, according to a tenth aspect of the present invention, the position adjustment of the plurality of stripes or dots to be projected onto the panel in the step (a) includes an adjustment by a correction lens of the exposure system for correcting an optical path of an exposure light beam for correction of beam landing.

Preferably, according to an eleventh aspect of the present invention, the method further comprises the step of: determining the position of a predetermined slot or dot of a color selecting mechanism by photographing means fixed in a predetermined position inside the panel and determining the position of a phosphor stripe or dot formed through the master mask on the inner surface of the panel by the photographing means to calculate the amount of deviation by comparison between the values of the two positions.

Preferably, according to a twelfth aspect of the present invention, the master mask of the exposure system used in the steps (a) and (b) includes a black matrix master mask used to expose said panel to form a black matrix, and said panel is exposed to form phosphor layers using the black matrix master mask by closing a predetermined portion of the black matrix master mask after the black matrix is formed in the step (b).

Preferably, according to a thirteenth aspect of the present invention, a light source of the exposure system used in the steps (a) and (b) includes a surface light source.

Preferably, according to a fourteenth aspect of the present invention, the step (a) includes the step of adjusting the position of a dual-purpose master mask of a first exposure system, the dual-purpose master mask being used for forming phosphor layers for a plurality of emitted colors, and the step (b) includes the step of mounting the panel in the first exposure system and sequentially moving the position of an image projected onto the inner surface of the panel so that the image projected onto the inner surface of the panel through the dual-purpose master mask is in corresponding relation to the phosphor layers for the plurality of emitted colors, to sequentially expose the panel for formation of the different phosphor layers.

Preferably, according to a fifteenth aspect of the present invention, the sequential movement of the position of the image projected onto the inner surface of the panel in corresponding relation to the phosphor layers for the plurality of emitted colors is performed by sequentially moving the position of a light source of the first exposure system.

Preferably, according to a sixteenth aspect of the present invention, the sequential movement of the position of the image projected onto the inner surface of the panel in corresponding relation to the phosphor layers for the plurality of emitted colors is performed by sequentially moving the dual-purpose master mask of the first exposure system.

The present invention is also intended for an exposure system for forming a fluorescent screen for a color cathode-ray tube by exposing a panel mounted therein to form a plurality of phosphor stripes or a plurality of phosphor dots on the panel of the color cathode-ray tube. According to a seventeenth aspect of the present invention, the exposure system comprises: a light source for exposure; and a position-adjustable master mask between the light source and the panel for projecting a plurality of stripes or a plurality of dots onto an inner surface of the panel.

Preferably, according to an eighteenth aspect of the present invention, the master mask includes a plurality of phosphor layer master masks corresponding to a plurality of emitted colors of phosphor layers.

Preferably, according to a nineteenth aspect of the present invention, the master mask further includes a black matrix master mask corresponding to a black matrix layer.

Preferably, according to a twentieth aspect of the present invention, the master mask includes a dual-purpose master mask corresponding to a plurality of emitted colors of phosphor layers and a black matrix layer.

Preferably, according to a twenty-first aspect of the present invention, the master mask includes a major surface having a predetermined curvature.

Preferably, according to a twenty-second aspect of the present invention, the master mask includes a flat major surface.

Preferably, according to a twenty-third aspect of the present invention, the master mask has a slot or dot array in a predetermined position, and the slot or dot array is determined by a stripe or dot array to be projected onto the inner surface of the panel and the position of the light source of the exposure system.

Preferably, according to a twenty-fourth aspect of the present invention, the master mask has a slot or dot array in a predetermined position, and the slot or dot array is determined by a stripe or dot array to be projected onto the inner surface of the panel through a slot or dot array of a color selecting mechanism in the color cathode-ray tube and the position of the light source of the exposure system.

Preferably, according to a twenty-fifth aspect of the present invention, the exposure system further comprises: first moving means for moving the master mask in a direction perpendicular to a major surface of the master mask; second moving means for moving the master mask in a first direction within the major surface of the master mask; third moving means for moving the master mask in a second direction within the major surface and orthogonal to the first direction of the master mask; and fourth moving means for rotating the master mask within the major surface.

Preferably, according to a twenty-sixth aspect of the present invention, the exposure system further comprises: first moving means for moving the light source in a direction perpendicular to a major surface of the master mask; second moving means for moving the light source in a first direction parallel to the major surface of the master mask; and third moving means for moving the light source in a second direction parallel to the major surface of the master mask and orthogonal to the first direction.

Preferably, according to a twenty-seventh aspect of the present invention, the exposure system further comprises: a correction lens between the master mask and the light source for correcting an optical path of an exposure light beam for correction of beam landing to adjust the position of the plurality of stripes or dots to be projected onto the inner surface of the panel through the master mask.

Preferably, according to a twenty-eighth aspect of the present invention, the light source includes a surface light source.

In the step (a) according to the first aspect of the present invention, the position of the plurality of phosphor stripes or dots of the image projected onto the panel through the master mask is adjusted to form the phosphor stripes or dots in the predetermined position of the color cathode-ray tube. The adjusted master mask is used for exposure in the step (b). This eliminates the need for the color selecting mechanism to be attached to or removed from the panel and improves the correspondence between the black matrix and phosphor layers by repeatability. Failures due to the attachment and removal of the color selecting mechanism are eliminated, and time required for the attachment and removal is reduced.

According to the method of the first aspect of the present invention, the master mask in the exposure system is substituted for the color selecting mechanism to eliminate the step of mounting the color selecting mechanism to the panel for exposure, efficiently forming the fluorescent screen. The reproducibility due to the attachment and removal of the color selecting mechanism is prevented from being lowered, whereby failures are reduced.

In the steps (a) and (b) according to the second aspect of the present invention, the first exposure systems having the different phosphor layer master masks are adapted to have the same set values to readily make an alignment between the phosphor layers for all emitted colors and the adjustment in corresponding relation to all emitted colors if a misalignment occurs. The same panel may be sequentially mounted in the plurality of first exposure systems for exposure, thereby shortening time.

The method of the second aspect of the present invention facilitates the adjustment of the plurality of first exposure systems of the same construction. Sequential mounting of the same panel in the plurality of first exposure systems for exposure provides efficient process of forming the fluorescent screen.

In the steps (a) and (b) according to the third aspect of the present invention, the second exposure system has the same set values as the first exposure systems except the master mask to readily make an alignment between the black matrix and the phosphor layers for emitted colors, reducing the misalignment therebetween.

The method of the third aspect of the present invention allows the first and second exposure systems to be adjusted similarly to reduce the misalignment between the black matrix and the phosphor layers, increasing a yield when the fluorescent screen is formed.

The master mask according to the fourth aspect of the present invention has the predetermined curvature and is easy to handle when the positional relation between the master mask and the panel is complicated, for example, when the flat master mask finds difficulty in the arrangement of the slots or dots, when the spacing between the panel and the master mask must be decreased, when the panel has locally different curvatures, and when the master mask must be adjusted to the curve of the color selecting mechanism.

The method of the fourth aspect of the present invention performs the steps (a) and (b) using the exposure system including the master mask having the predetermined curvature to readily satisfy the complicated relation between the panel and the master mask. This facilitates the operation when the panel and the master mask are in complicated relation, providing efficient formation of the fluorescent screen.

The master mask according to the fifth aspect of the present invention has the flat major surface to readily handle the basic panel.

The method of the fifth aspect of the present invention facilitates the handling of the basic panel to provide efficient formation of the fluorescent screen.

The master mask according to the sixth aspect of the present invention is disposed in the predetermined position of the exposure system and designed such that light from the light source of the exposure system projects the phosphor stripes or dots on the inner surface of the glass panel serving as a target to facilitate the adjustment in the step (a).

The method of the sixth aspect of the present invention may readily adjust the position of the phosphor stripes or dots projected on the inner surface of the panel by the master mask to provide efficient formation of the fluorescent screen.

The master mask according to the seventh aspect of the present invention is disposed in the predetermined position of the exposure system and designed such that light from the light source of the exposure system projects the phosphor stripes or dots on the inner surface of the panel serving as a target in accordance with the stripe or dot array of the color selecting mechanism to facilitates the adjustment in the step (a).

The method of the seventh aspect of the present invention may readily adjust the position of the phosphor stripes or dots projected on the inner surface of the panel by the master mask in accordance with the color selecting mechanism to provide efficient formation of the fluorescent screen.

The master mask according to the eighth aspect of the present invention moves in the direction perpendicular to the major surface of the master mask, in the first direction within the major surface, in the second direction within the major surface, and in the rotational direction within the major surface to readily adjust the position of the phosphor stripes or dots projected onto the inner surface of the panel.

The method of the eighth aspect of the present invention readily adjust the position of the phosphor stripes or dots projected onto the inner surface of the panel by the master mask to provide efficient formation of the fluorescent screen.

The light source according to the ninth aspect of the present invention moves in the direction perpendicular to the major surface of the master mask, in the first direction parallel to the major surface, and in the second direction parallel to the major surface and orthogonal to the first direction to readily adjust the position of the phosphor stripes or dots projected onto the inner surface of the panel.

The method of the ninth aspect of the present invention readily adjust the position of the phosphor stripes or dots projected onto the inner surface of the panel by the master mask to provide efficient formation of the fluorescent screen.

The optical path is easily corrected using the collection lens according to the tenth aspect of the present invention. The position of the phosphor stripes or dots projected on the panel is readily adjusted.

The method of the tenth aspect of the present invention readily adjust the position of the phosphor stripes or dots projected onto the inner surface of the panel by the master mask to provide efficient formation of the fluorescent screen.

The photographing means according to the eleventh aspect of the present invention determines the deviation of the position of the phosphor stripe or dot formed on the inner surface of the panel by the master mask from the position of the predetermined slot or dot of the color selecting mechanism to readily correct the position shift of the phosphor stripe or dot to be projected through the master mask.

The method of the eleventh aspect of the present invention readily corrects the position shift of the phosphor stripe or dot to be projected through the master mask to form the fluorescent screen correctly and efficiently.

In the step (b) according to the twelfth aspect of the present invention, the predetermined portion of the black matrix master mask is closed to expose the panel for forming the phosphor layers using the black matrix master mask, reducing the misalignment between the phosphor layers and the black matrix.

The method of the twelfth aspect of the present invention reduces the misalignment between the phosphor layers and black matrix to increase a yield when the fluorescent screen is formed.

The light source according to the thirteenth aspect of the present invention is the surface light source which emits substantially parallel light beams to the master mask. Thus the positional relation of the phosphor stripes or dots projected onto the panel by exposure is identical with the positional relation of the slots or dots of the master mask. This facilitates the adjustment of the position of the phosphor stripes or dots to be projected on the panel.

The method of the thirteenth aspect of the present invention readily adjust the position of the phosphor stripes or dots to be projected onto the panel to efficiently form the fluorescent screen.

According to the fourteenth aspect of the present invention, one dual-purpose master mask is sufficient to form the plurality of phosphor layers to reduce the misalignment between the phosphor layers for the respective emitted colors. The dual-purpose master mask, if used also for the black matrix, can reduce the misalignment between the black matrix and the phosphor layers.

The method of the fourteenth aspect of the present invention reduces the misalignment between the black matrix and the phosphor layers and between the phosphor layers for the respective emitted colors to efficiently form the fluorescent screen.

The light source according to the fifteenth aspect of the present invention may be moved to move the position of the image to be projected onto the panel to readily expose the panel for formation of the phosphor layers corresponding to the plurality of emitted colors.

The method of the fifteenth aspect of the present invention facilitates the exposure for formation of the plurality of phosphor layers to efficiently form the fluorescent screen.

The dual-purpose master mask according to the sixteenth aspect of the present invention may be moved to move the position of the image to be projected on the panel to facilitate the exposure for formation of the plurality of phosphor layers corresponding to the plurality of emitted colors.

The method of the sixteenth aspect of the present invention facilitates the exposure for formation of the plurality of phosphor layers to efficiently form the fluorescent screen.

The master mask according to the seventeenth aspect of the present invention through which the plurality of phosphor stripes or dots are projected onto the inner surface of the panel is substituted for the color selecting mechanism fitted on the inner surface of the panel when the panel is exposed.

The exposure system of the seventeenth aspect of the present invention eliminates the need to attach and remove the color selecting mechanism when the panel is exposed to reduce defective products. The exposure system also shortens the time required to attach and remove the color selecting mechanism to efficiently form the fluorescent screen.

According to the eighteenth aspect of the present invention, each of the plurality of phosphor layer master masks corresponds to one of the emitted colors. Thus, the color selecting mechanism is not required to be fitted on the inner surface of the panel, and the plurality of exposure processes may be performed for formation of the phosphor layers corresponding to the plurality of emitted colors.

The exposure system of the eighteenth aspect of the present invention may form the phosphor layers corresponding to the plurality of emitted colors to achieve an exposure system with higher levels of function.

The exposure system of the nineteenth aspect of the present invention allows the black matrix master mask for exclusive use to the black matrix to be used to expose the panel for formation of the black matrix without the color selecting mechanism fitted on the inner surface of the panel.

The exposure system of the nineteenth aspect of the present invention can perform the exposure for formation of the black matrix as well as the exposure for formation of the phosphor layers to readily make an alignment between the black matrix and the phosphor layers.

According to the twentieth aspect of the present invention, the use of the dual-purpose master mask reduces the misalignment between the phosphor layers and the black matrix and the misalignment between the phosphor layers for the respective emitted colors.

The exposure system of the twenties aspect of the present invention reduces the misalignment between the black matrix and the phosphor layers to reduce the defective products.

The master mask according to the twenty-first aspect of the present invention having the curvature is used to expose the panel without difficulty in accordance with the panel when the positional relation between the panel and the master mask is complicated.

The exposure system of the twenty-first aspect of the present invention is easy to handle when the positional relation between the master mask and the panel is complicated.

The master mask according to the twenty-second aspect of the present invention has the flat major surface and is easy to handle, for example, when the phosphor stripes or dots are formed on the basic panel.

The exposure system of the twenty-second aspect of the present invention is easy to handle when the normal panel is used.

The master mask according to the twenty-third aspect of the present invention is disposed in the predetermined position of the exposure system and designed such that light from the light source of the exposure system projects the phosphor stripe or dot array on the inner surface of the glass panel serving as a target, thereby readily adjust the position of the phosphor stripes or dots to be projected.

The exposure system of the twenty-third aspect of the present invention readily adjusts the position of the phosphor stripes or dots to be projected, to efficiently expose the panel.

The master mask according to the twenty-fourth aspect of the present invention is disposed in the predetermined position of the exposure system and designed such that light from the light source of the exposure system projects the phosphor stripe or dot array on the inner surface of the panel serving as a target in accordance with the slot or dot array of the color selecting mechanism to readily adjust the position of the phosphor stripes or dots to be projected.

The exposure system of the twenty-fourth aspect of the present invention readily adjusts the position of the phosphor stripes or dots to be projected, to efficiently expose the panel.

According to the twenty-fifth aspect of the present invention, the first to fourth moving means are used to adjust the position of the master mask to adjust the projection position of the phosphor stripes or dots on the inner surface of the panel.

The exposure system of the twenty-fifth aspect of the present invention readily adjusts the position of the phosphor stripes or dots to be projected, to efficiently expose the panel.

According to the twenty-sixth aspect of the present invention, the first to third moving means are used to adjust the position of the light source to adjust the projection position of the phosphor stripes or dots on the inner surface of the panel.

The exposure system of the twenty-sixth aspect of the present invention readily adjusts the position of the phosphor stripes or dots to be projected, to efficiently expose the panel.

The correction lens according to the twenty-seventh aspect of the present invention can easily adjust the position of the plurality of phosphor stripes or dots to be projected on the inner surface of the panel through the master mask.

The exposure system of the twenty-seventh aspect of the present invention readily adjusts the position of the phosphor stripes or dots to be projected, to efficiently expose the panel.

According to the twenty-eighth aspect of the present invention, the light source includes the surface light source for emitting substantially parallel light beams. Thus, the position of the phosphor stripes or dots to be projected on the panel is easily adjusted.

The exposure system of the twenty-eighth aspect of the present invention readily adjusts the position of the phosphor stripes or dots to be projected, to efficiently expose the panel.

It is therefore an object of the present invention to form a fluorescent screen for a color cathode-ray tube such that a misalignment between a black matrix and phosphor layers due to repeatability of attachment and removal of a color selecting mechanism to and from a glass panel is minimized by eliminating the attachment and removal of the color selecting mechanism, without failures due to the attachment and removal for a shortened operating time.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

First Preferred Embodiment

Figure 1:
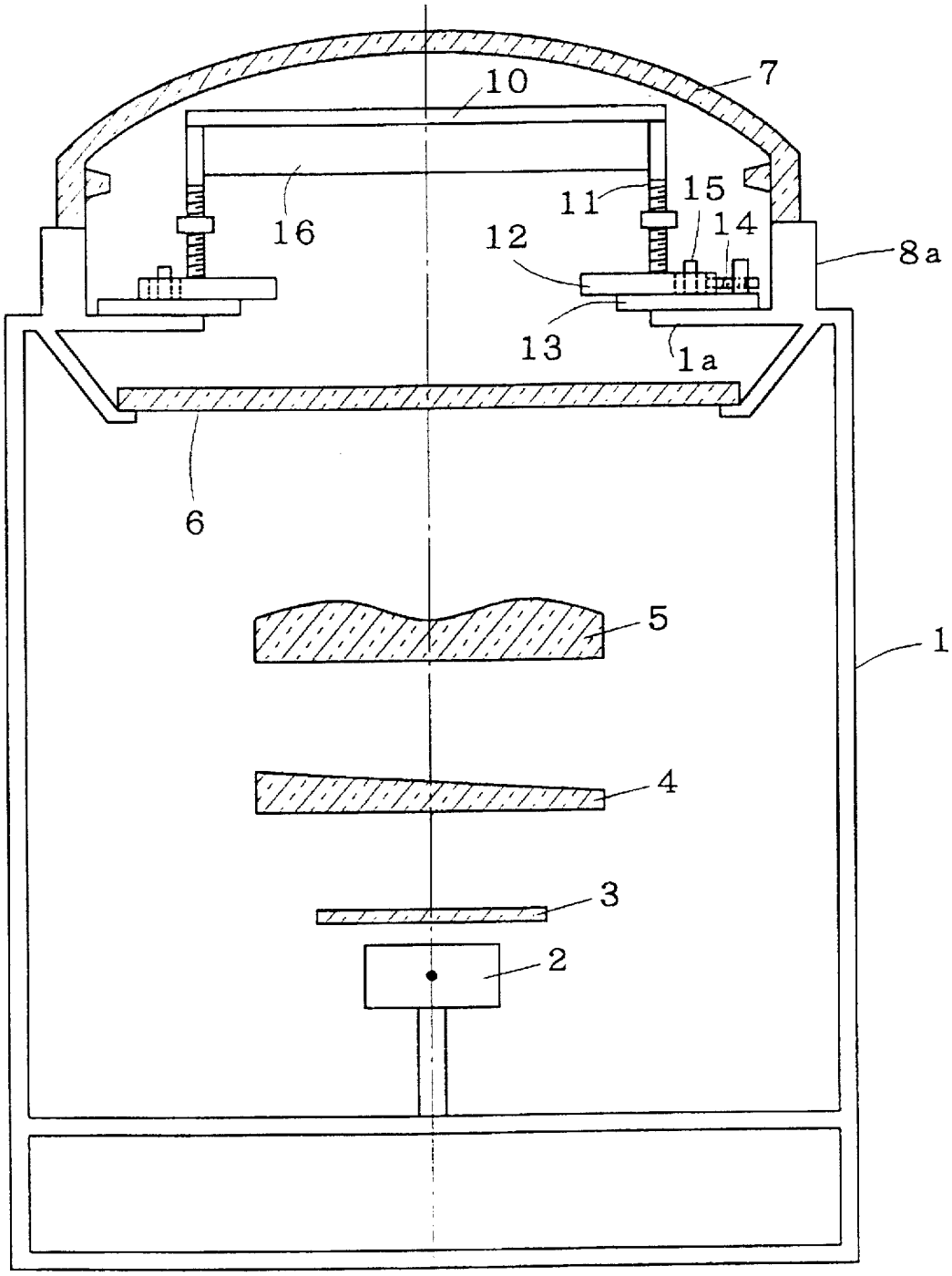
FIG. 1 is a cross-sectional side view of an exposure system according to a first preferred embodiment of the present invention.
Figure 13:
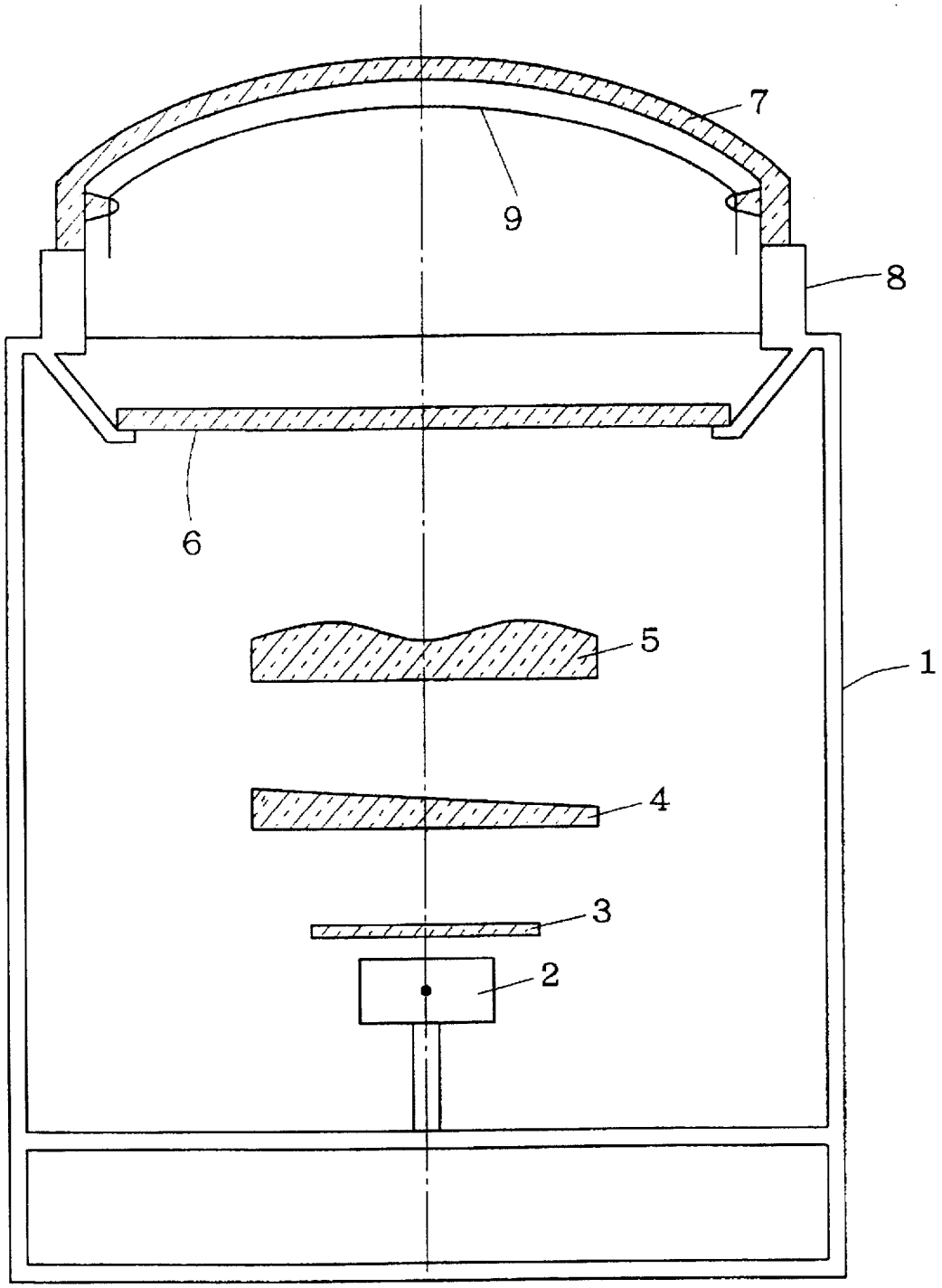
FIG. 13 (BACKGROUND ART)
FIG. 13 is a cross-sectional side view of a conventional exposure system.

A method of forming a fluorescent screen for a color cathode-ray tube will be described according to a first preferred embodiment of the present invention, with reference to FIGS. 1 to 7. In the method of the first preferred embodiment, a slot or dot array of a master mask is in a one-to-one correspondence with each of the phosphor layers for respective emitted colors and the black matrix layer. FIG. 1 is a cross-sectional view of an exposure system for use in the method of the first preferred embodiment. In FIG. 1, the reference character 8a designates a support portion at the top of a box-like body 1 and having a portion abutting against the outer edge of a glass panel 7 for alignment of the glass panel 7 for supporting the glass panel 7 so that the glass panel 7 does not deviate; 10 designates a master mask having a plurality of openings (not shown in cross section) corresponding to slots or dots for allowing light to pass through to project an image of the slots or dots onto an inner surface of the glass panel 7; 11 designates retractable support posts for supporting the master mask 10; 12 designates a base plate having an opening in the center thereof and to which the support posts 11 are fixed; 13 designates a rotating mechanism disposed on a shelf portion 1a of the box-like body 1 for supporting the base plate 12 and rotatable relative to the box-like body 1 and having an opening in the center thereof; 14 designates screws rotatably supported by the rotating mechanism 13 in fixed positions and contacting side surfaces of the base plate 12 for moving the base plate 12 relative to the rotating mechanism 13; 15 designates pins in engagement with holes of the base plate 12 for horizontally movably fixing the base plate 12 and having a diameter smaller than that of the holes of the base plate 12; and 16 designates a frame on the periphery of the master mask 10 for preventing light from coming out in undesired directions. Like reference numerals are used to designate portions corresponding to those of FIG. 13. The support portion 8a is designed to abut against a portion known as an alignment reference of the glass panel 7 for alignment.

Figure 2:
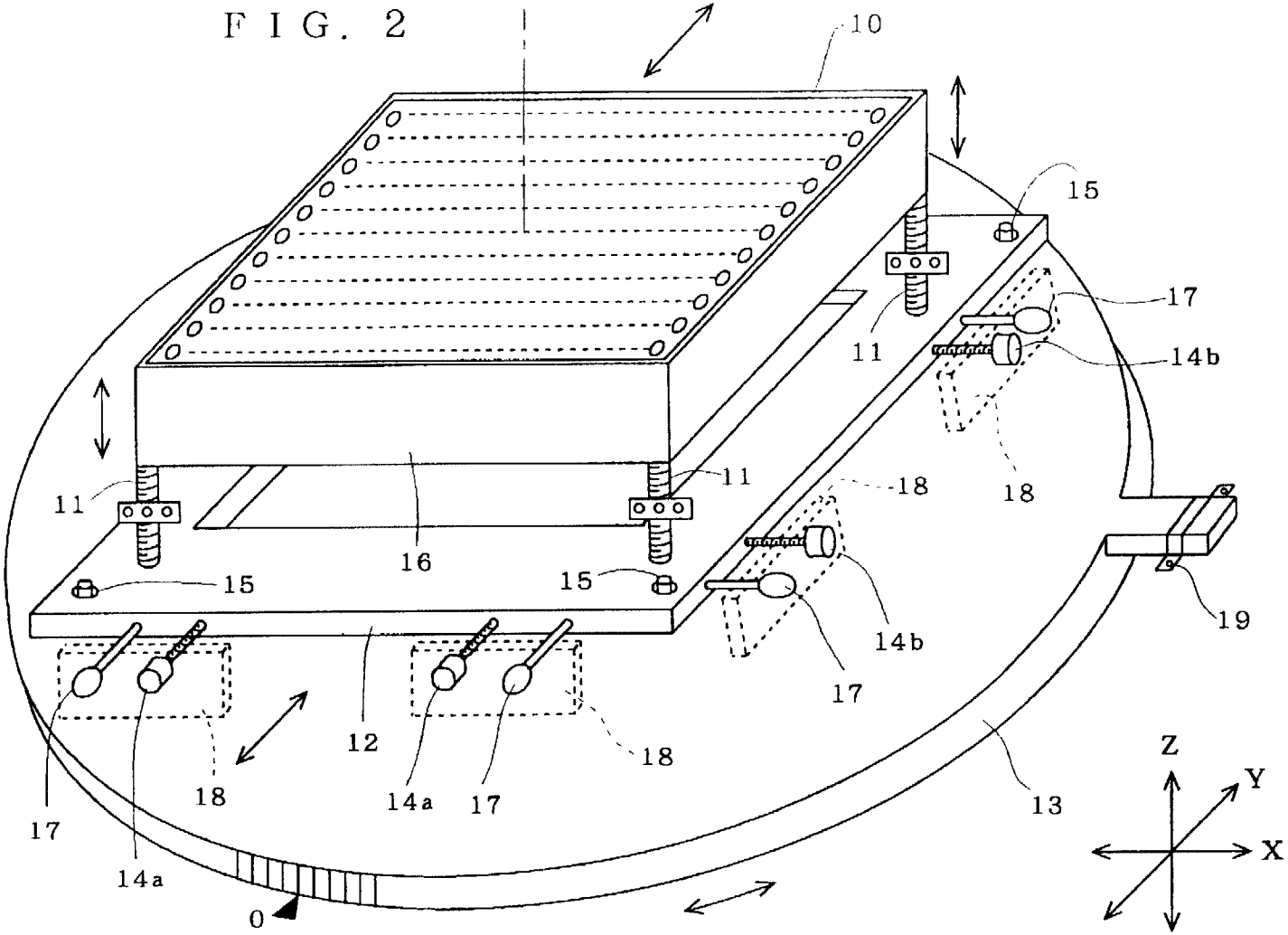
FIG. 2 is an enlarged view of a master mask portion of the exposure system of the first preferred embodiment.

FIG. 2 is a perspective view of the master mask and a position adjusting mechanism thereof. In FIG. 2, the reference numeral 17 designates determining instruments for determining the amount of movement of the master mask 10 to display or output the amount; 18 designates support members fixed on the rotating mechanism 13 for rotatably supporting screws 14a, 14b in fixed positions; and 19 designates a stopper for fixing the rotating mechanism 13 in any position. The master mask 10 may be rotated and moved in X, Y, Z directions with respect to the axis of the tube by the position adjusting mechanism. The support posts 11 which are threaded are extended and retracted by rotating either clockwise or counterclockwise to move the master mask 10 in the Z direction. The support posts 11 at four corners may be independently extended and retracted, permitting adjustment of a slight tilt. The screws 14a, 14b allow the master mask 10 to move in parallel to the plane thereof, that is, in the X and Y directions. The base plate 12 is moved in the Y direction relative to the rotating mechanism 13 by rotating the screws 14a, and the base plate 12 is moved in the X direction relative to the rotating mechanism 13 by rotating the screws 14b. The base plate 12 may be moved in a rotational direction by adjusting the screws 14a, 14b. Although not shown in FIG. 2, there is provided a member on a side of the rotating mechanism 13 for guiding the rotation of the rotating mechanism 13 to prevent translation thereof so that the rotating mechanism 13 performs only a rotational motion. Rotation of the rotating mechanism 13 allows the master mask 10 to rotate on the axis of the tube. About ±10° rotation of the rotating mechanism 13 is sufficient. The amount of movement of the master mask 10 in the X and Y directions are determined by the determining instruments 17. Although not shown in FIG. 2, there is provided a measuring instrument for measuring the angle of rotation and the distance of movement in the Z direction of the four corners of the master mask 10. The rotating mechanism 13 is rotated manually but may be automatically rotated by rotating a gear in mesh engagement with a toothed side of the rotating mechanism 13.

Figure 3:
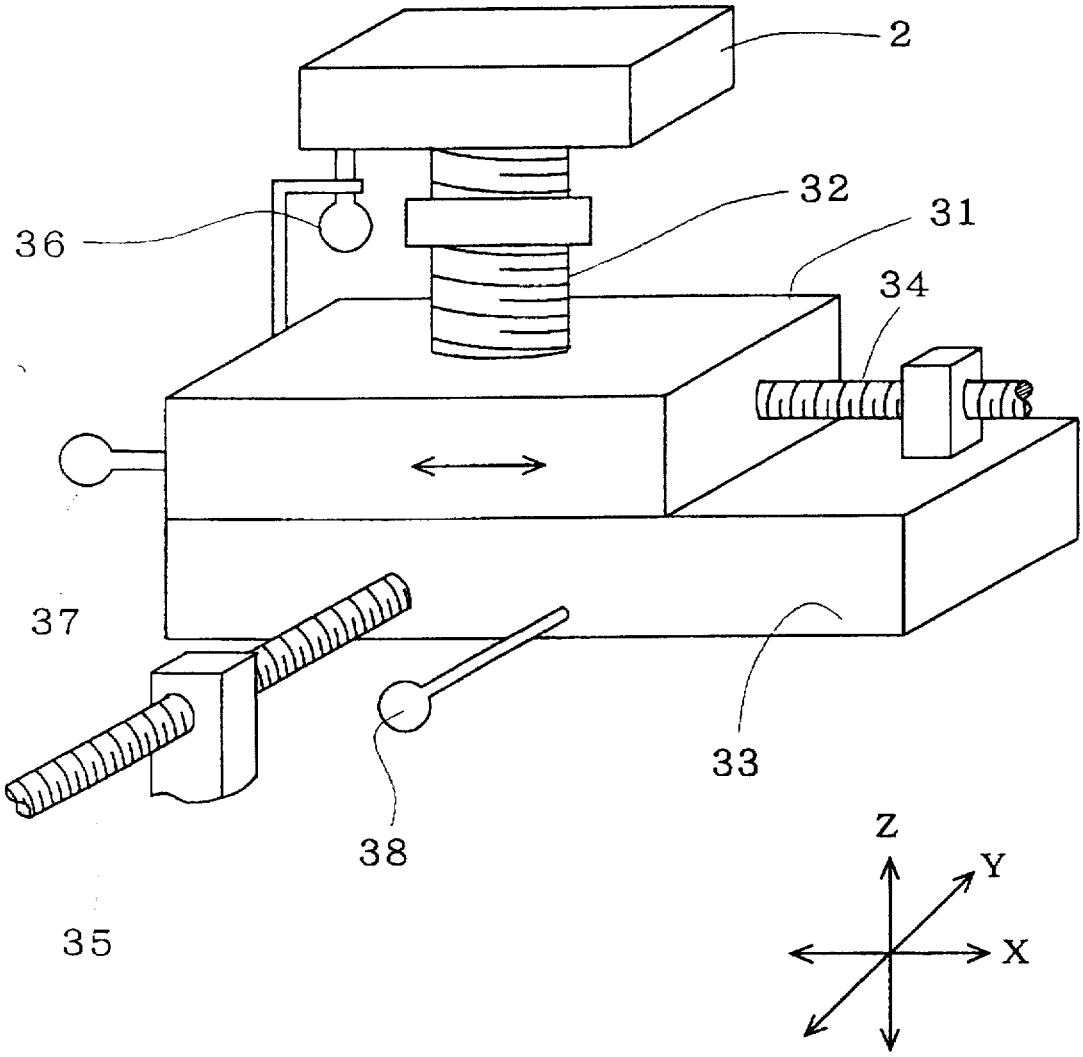
FIG. 3 is a perspective view of a light source portion of the exposure system of the first preferred embodiment.

The light source 2 has a mechanism for position adjustment. FIG. 3 is a perspective view of the position adjusting mechanism for the light source 2. In FIG. 3, the reference numeral 2 designates a light source; 31 designates a first table; 32 designates a support post on the first table 31 for retractably supporting the light source 2; 33 designates a second table disposed under the first table 31; 34 designates a feed screw for moving the first table 31 in the X direction; 35 designates a feed screw for moving the second table 33 in the Y direction; 36 designates a determining instrument for determining the distance of movement of the light source 2 in the Z direction; 37 designates a determining instrument for determining the distance of movement of the first table 31 in the X direction; and 38 designates a determining instrument for determining the distance of movement of the second table 33 in the Y direction.

Figure 4:
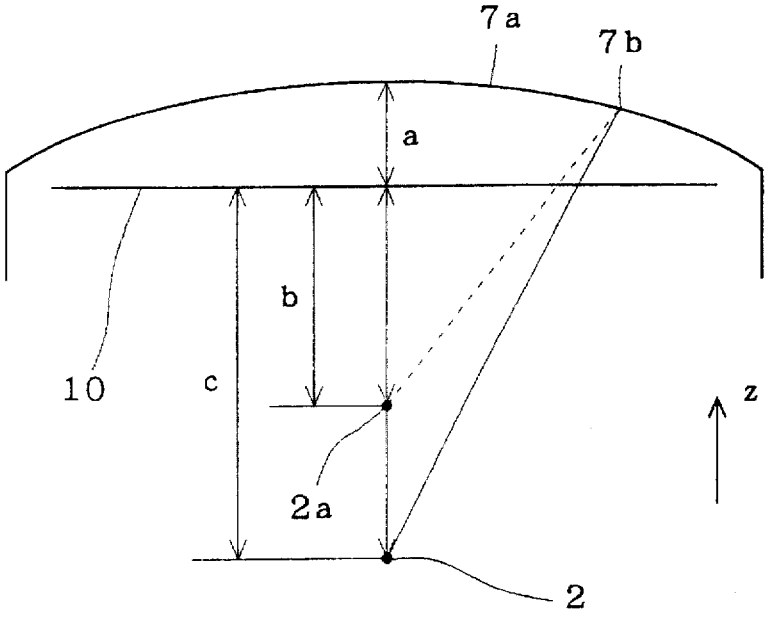
FIGS. 4 and 5 are cross-sectional views illustrating the relation between a light source, a panel, and a master mask of the first preferred embodiment.

The slot or dot array of the master mask 10 is determined by a phosphor stripe or dot array on the inner surface of the glass panel 7, the position of the light source 2 of the exposure system, and a slot or dot array of the color selecting mechanism 9 in the color cathode-ray tube. FIG. 4 illustrates the relation between the master mask 10 and the inner surface of the glass panel 7. In FIG. 4, the reference numeral 2 designates a light source; the reference character 2a designates a point obtained by translating the light source 2 in the Z direction; 7a designates a inner surface of the glass panel 7; 7b designates a target position on the inner surface of the glass panel 7 onto which the image is projected; and 10 designates a master mask. The reference character a designates a distance between the master mask 10 and the center of the inner surface 7a of the glass panel 7; b designates a distance between the master mask 10 and the point 2a; and c designates a distance between the master mask 10 and the light source 2. To project the image in the target position 7b through the openings corresponding to the slots or dots of the master mask 10, the openings are required to be positioned depending upon the position of the light source 2 and the position of the inner surface of the panel relative to the master mask 10. For example, if the light source 2 is moved to the point 2a, the path of the light beam emitted from the light source 2 is shifted and the openings must be positioned to compensate for the shift. The use of the master mask 10 formed with the openings which are formed in consideration for the relation between the target position 7b and the position of the light source 2 facilitates the phosphor stripe or dot formation in the target position.

Figure 5:
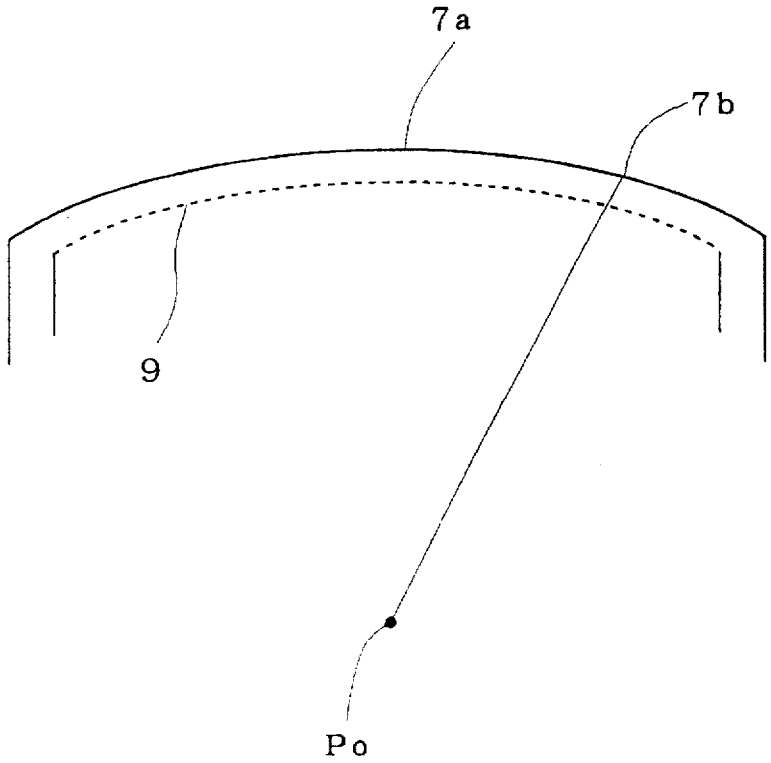

FIG. 5 illustrates a process for determining the target position 7b by using the color selecting mechanism 9. In FIG. 5, PO represents the center of polarized light relative to the glass panel inner surface 7a. Since the glass panel 7 and the color selecting mechanism 9 are in one-to-one corresponding relation, the target position 7b is a position on the glass panel inner surface 7a which polarized light reaches from the center of polarized light PO through the color selecting mechanism 9 fitted on the inner surface of the glass panel 7. In this manner, the determination of the target position using the color selecting mechanism 9 which is in one-to-one correspondence with the glass panel facilitates the phosphor stripe or dot formation in the target position in accordance with the color selecting mechanism 9.

Figure 6:
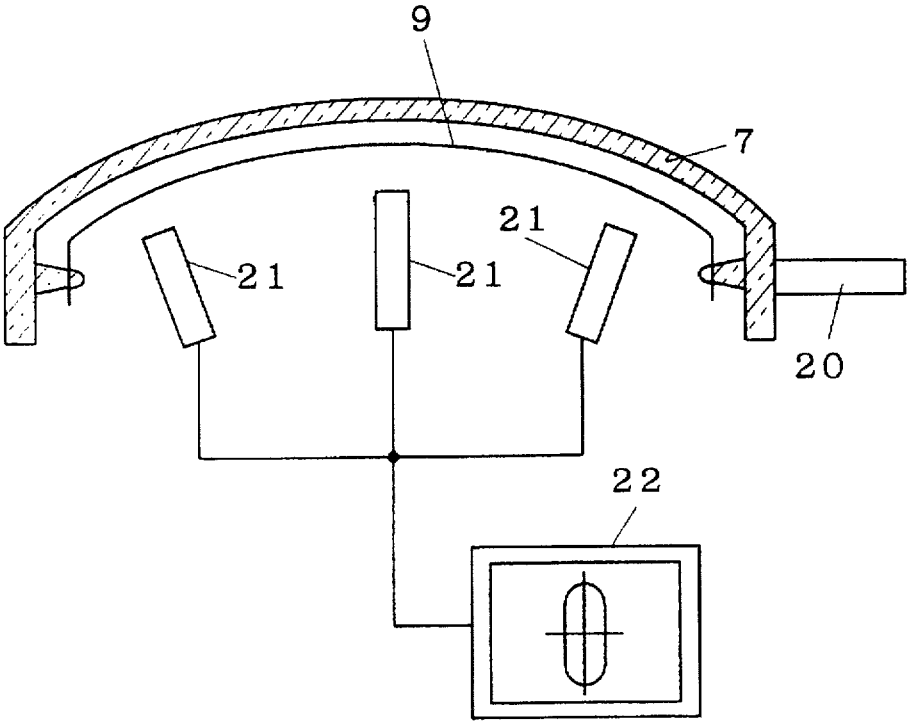
FIG. 6 schematically illustrates a system using a CCD camera for determining the position of slots or dots of a color selecting mechanism of the first preferred embodiment.
Figure 7:
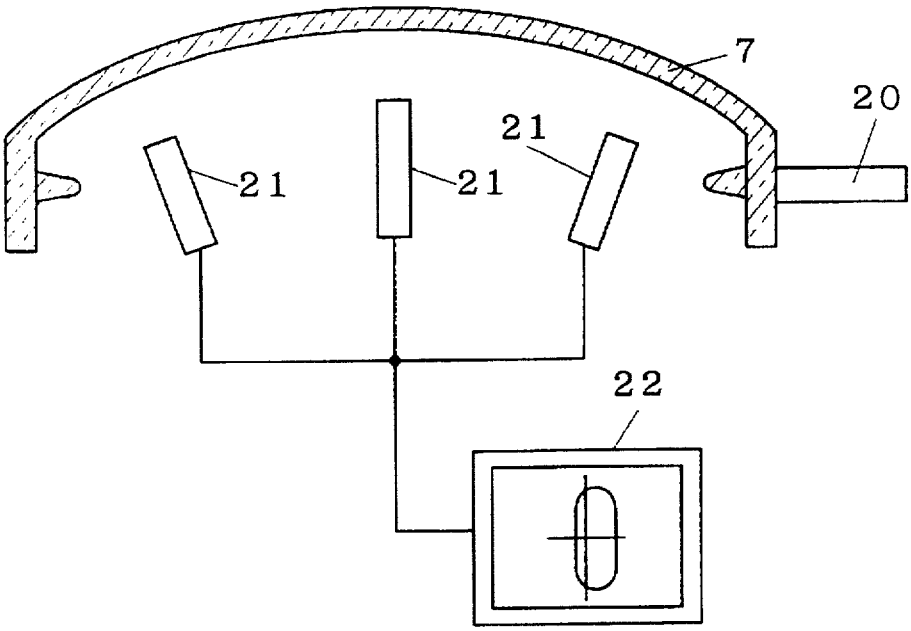
FIG. 7 schematically illustrates a system using a CCD camera for determining the position of stripes or dots of a black matrix of the first preferred embodiment.

The method of forming the fluorescent screen for the color cathode-ray tube according to the first preferred embodiment of the present invention will now be described with reference to FIGS. 6 to 8. FIGS. 6 and 7 are cross-sectional views of a mechanism for determining the positional relation of the color selecting mechanism 9 by a CCD camera. In FIGS. 6 and 7, the reference numeral 7 designates a glass panel; 9 designates a color selecting mechanism fitted on the inner surface of the glass panel 7; 20 designates an alignment jig abutting against the outer surface of the glass panel 7 for determination of the positional relation of the color selecting mechanism 9 in the position known as the alignment reference; 21 designates light receiving portions of the CCD camera fixed in position relative to the jig 20; and 22 designates a monitor for displaying image information from the light receiving portions 21 of the CCD camera.

Figure 8:
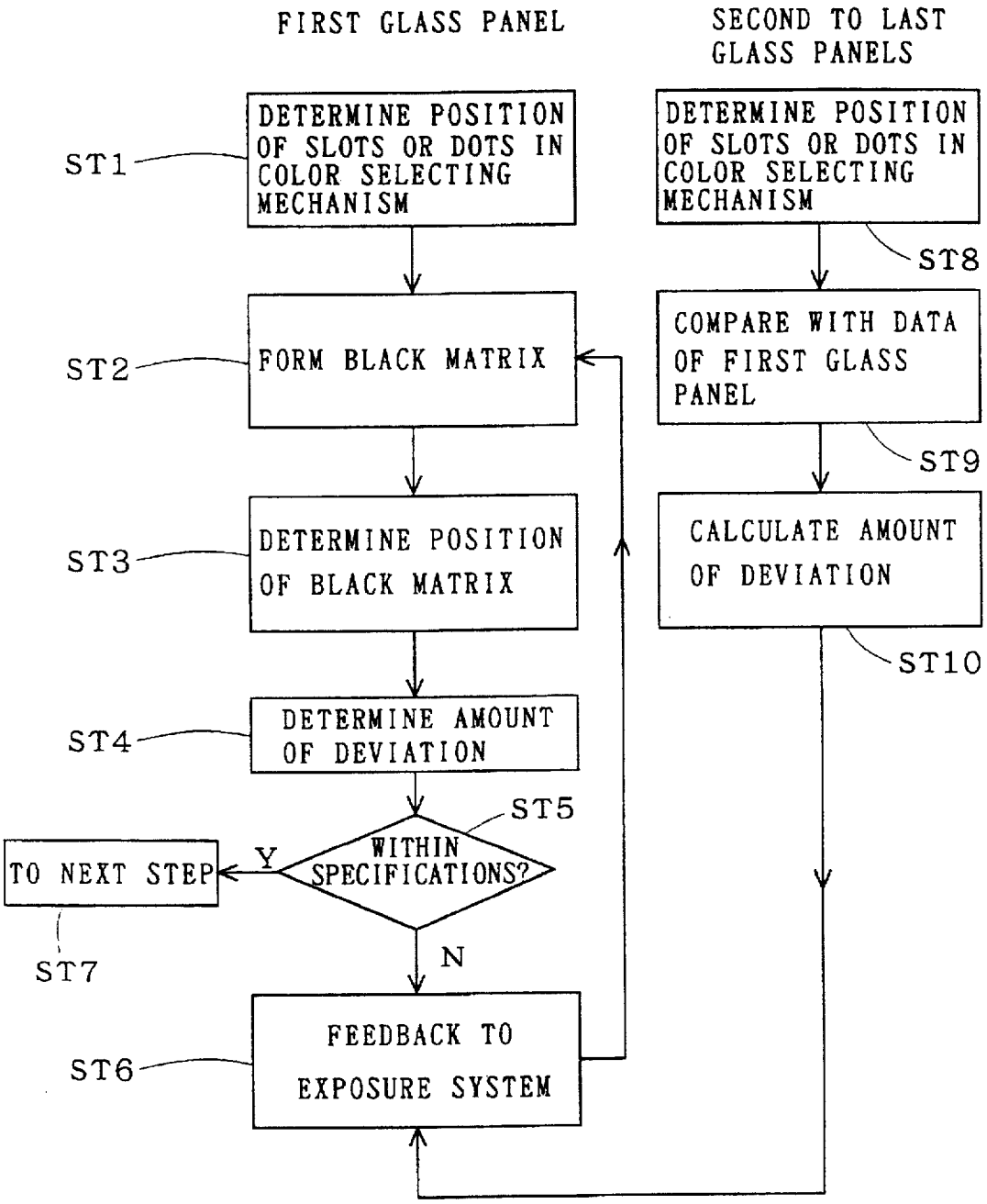
FIG. 8 is a flow chart illustrating a procedure for forming the black matrix of the first preferred embodiment.

FIG. 8 is a flow chart illustrating the procedure for forming the fluorescent screen for the color cathode-ray tube according to the first preferred embodiment of the present invention. The light receiving portions 21 of the CCD camera photograph specified reference slots or dots of the color selecting mechanism 9 from inside the glass panel 7 on the basis of a panel outer configuration reference, with the color selecting mechanism 9 fitted on the inner surface of the panel glass 7, as shown in FIG. 6. The position of the slots or dots photographed by the reference light receiving portions 21 of the CCD camera is determined from the image on the monitor 22 (process step ST1). An alignment value is calculated depending upon the read position of the reference slots or dots. The color selecting mechanism 9 is removed from the glass panel 7, and the subsequent process steps until the exposure step are performed in the conventional manner.

For exposure of a first glass panel, only the glass panel 7 is placed on the exposure system as shown in FIG. 1, with the color selecting mechanism 9 removed from the glass panel 7. The position of the master mask 10 is controlled using the position adjusting mechanism in accordance with the alignment value. Light emitted from the light source 2 is subjected to light quantity distribution adjustment by the light intensity correction filter 3 and is then subjected to light path correction by the first correction lens 4 and the second correction lens 5. The light then passes through the cover glass 6, base plate 12, rotating mechanism 13, and the slots or dots of the black matrix master mask 10 to reach and expose the predetermined glass panel 7 in an inner surface position. The first correction lens 4 and second correction lens 5 may be removed, if not required. After the exposure, the black matrix layer is formed in the conventional manner (process step ST2).

The glass panel 7 formed with the black matrix layer is aligned using the jig 20 in a manner similar to that before the formation of the black matrix layer as shown in FIG. 7. The light receiving portions 21 of the CCD camera photograph specified reference stripes or dots of the black matrix formed on the inner surface of the glass panel 7. The position of the reference stripes or dots on the monitor 22 is determined (process step ST3).

The determined position is compared with data determined when the color selecting mechanism 9 is fitted on the inner surface of the glass panel 7, and the amount of deviation of the stripes or dots of the black matrix is determined (process step ST4).

The amount of deviation is judged in the process step ST5. If the amount of deviation is within specifications, the flow proceeds to the next step. If it is out of specifications, the flow proceeds to the process step ST6 in which the master mask 10 is moved by the position adjusting mechanism shown in FIG. 2 and the amount of deviation is fed back to the exposure system for correction of the position of the stripes or dots on the inner surface of the glass panel 7. The process steps ST2 to ST6 are repeated until the position correction is achieved. If the correction is not achieved by the above described process, the second correction lens 5 is mounted and removed or a different second correction lens 5 is used.

The phosphor stripes or dots are then formed. The glass panel 7 is exposed for each emitted color by a plurality of exposure systems with master masks 10 for respective emitted colors mounted therein on the basis of the result of the position adjustment by using set values similar to the set values of the black matrix exposure system. The color selecting mechanism 9 is not mounted for the exposure. The alignment between the black matrix and phosphor layers is similarly adjusted by the master mask 10, the position control of the light source 2, and the second correction lens 5. Thereafter, the glass panel 7 is coated with lacquer and subjected to aluminum deposition. This completes the formation of the fluorescent screen.

For exposure of second to last glass panels, the position of predetermined slots or dots is determined using the CCD camera, with the color selecting mechanism 9 fitted on the inner surface of the glass panel 7 as shown in FIG. 6 (process step ST8). The result of the determination is compared with the data of the first glass panel (process step ST9). Then the amount of deviation is calculated (process step ST10). The position of the master mask 10 or the light source 2 is adjusted using the position adjusting mechanism of the exposure system in accordance with the amount of deviation (process step ST6). Then the black matrix is formed by the same procedure as the formation of the first glass panel (process step ST2). The process steps ST2 to ST6 are repeated until the amount of deviation falls within specifications in the same manner as the formation of the first glass panel. The phosphor layers are formed in the same manner as the formation of the first glass panel. In the continuous formation of the second to last glass panels, if the second glass panel is out of specifications in the process step ST5, the process steps from ST8 are performed again (after the black matrix is removed once) after the process for the third glass panel.

Figure 9:
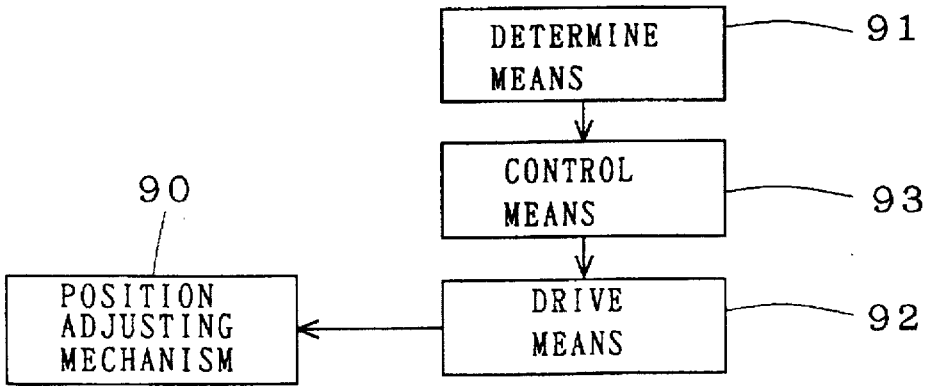
FIG. 9 is a block diagram of a structure for automatically forming a fluorescent screen of the first preferred embodiment.

The above described procedure may be automated. FIG. 9 is a block diagram illustrating the combination of functions for automation. In FIG. 9, the reference numeral 90 designates a position adjusting mechanism for adjusting the position of the master mask 10 or the position of the light source 2 shown in FIGS. 2 and 3; 91 designates a determining means for determining the position of predetermined slots or dots using the CCD camera shown in FIGS. 6 and 7; 92 designates a drive means for driving feed screws of the position adjusting mechanism 90 by rotation of a motor and the like; and 93 designates a control means for calculating the amount of deviation on the basis of the value determined by the determining means 91 to control the drive means 92 in response to the calculated amount of deviation.

The determining means 91 determines the position of slots or dots of the color selecting mechanism 9 fitted on the inner surface of the first glass panel by using the CCD camera. The determining means 91 also determines the position of the predetermined stripes or dots of the black matrix formed on the inner surface of the glass panel 7 by using the same CCD camera after the first glass panel 7 is exposed to form the black matrix. The determining means 91 determines the position of slots or dots of the color selecting means 9 fitted on the inner surface of the second glass panel 7 by using the same CCD camera. The control means 93 receives the result of determination from the determining means 91 to calculate the amount of deviation. The control means 93 outputs data required to drive the drive means 92 such as data about the number of rotations of the feed screws in response to the calculated amount of deviation. The control means 93 also judges whether the amount of deviation (for the color selecting mechanism 9 and the black matrix) is within or out of specifications for discrimination. The drive means 92 drives the position adjusting mechanism 90 in response to output data from the control means 93 to feed back the amount of deviation to the exposure system.

Second Preferred Embodiment

Figure 10:
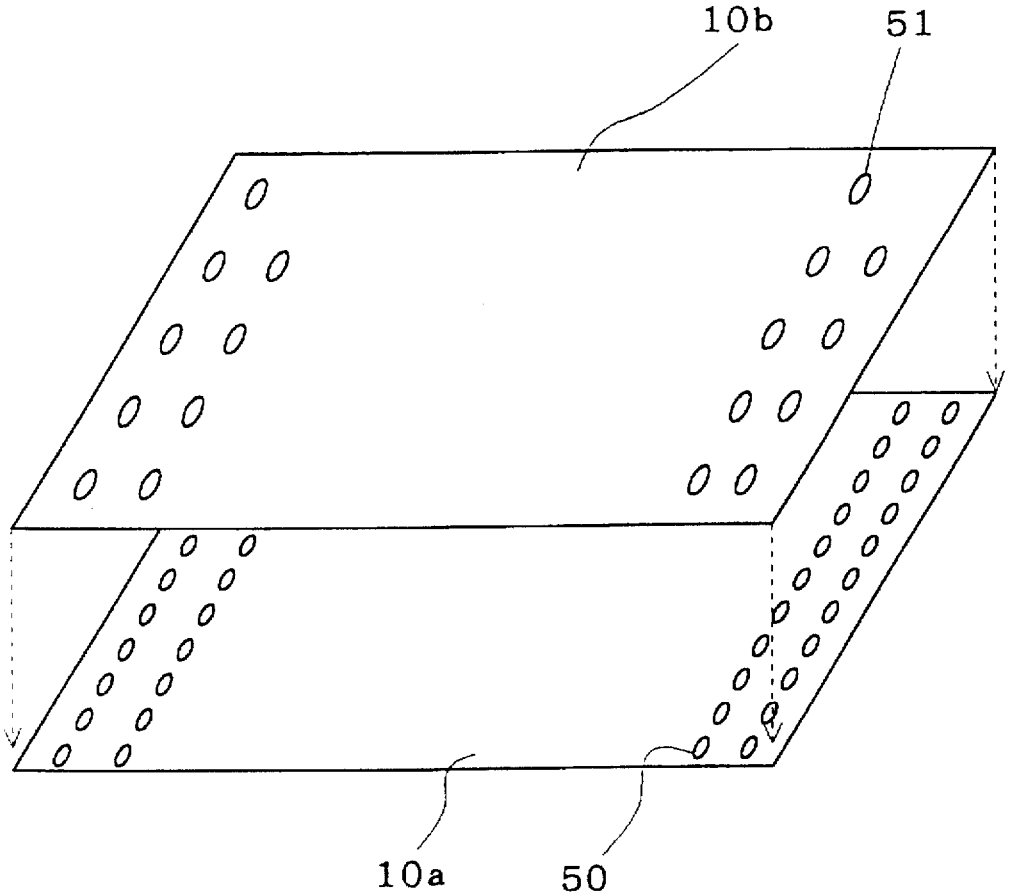
FIG. 10 is a perspective view of the master mask according to a second preferred embodiment of the present invention.

The method of forming the fluorescent screen for the color cathode-ray tube will now be described according to a second preferred embodiment of the present invention. The plurality of exposure systems for the black matrix and the phosphor layers are used in the first preferred embodiment. To share one exposure system between the black matrix and the phosphor layers, a phosphor layer master mask conversion cover **10*b* is used above a black matrix master mask 10*a* as shown in FIG. 10 after the formation of the black matrix. A plurality of dots or slots 50 are formed in the black matrix master mask 10*a*. The number of dots or slots 50 in the black matrix master mask 10*a* is greater than the number of dots or slots 51 in the phosphor layer master mask conversion cover 10*b*. For example, the number of dots or slots 50 is about three times the number of dots or slots 51 when three emitted colors of the phosphor layers are used. The phosphor layer master mask conversion cover 10*b* is used to close some holes of the black matrix master mask 10*a* which are not required for the emitted colors. For this purpose, the dots or slots 51 of the phosphor layer master mask conversion cover 10*b* are greater in size than the dots or slots 50 of the black matrix master mask 10*a***. Another phosphor layer master mask conversion cover having holes in different positions is used for exposure for formation of a phosphor layer of another emitted color. The black matrix master mask may be used without position adjustment to form the phosphor layers and the black matrix layer. This readily eliminates the misalignment between the black matrix layer and the phosphor layers.

Third Preferred Embodiment

The method of forming the fluorescent screen for the color cathode-ray tube will now be described according to a third preferred embodiment of the present invention. The slots or dots in the master mask 10 are in a one-to-one correspondence with the phosphor stripes or dots formed on the inner surface of the glass panel 7 in the second preferred embodiment. In the third preferred embodiment, phosphor stripes or dots for another emitted color may be formed by a predetermined amount of movement of the image projected on the inner surface of the glass panel 7 through one master mask 10. This is achieved by automatically moving the light source 2 of FIG. 1 to the position of each emitted color and/or automatically moving the master mask to the position corresponding to each emitted color during exposure. One and the same master mask 10 (for one exposure system) may be used for the black matrix and phosphor layers. Otherwise, master masks 10 having the same performance specifications may be used respectively for the black matrix and the phosphor layers. A mechanism for moving the master mask 10 or the light source 2 may be achieved by the mechanism as described in the first preferred embodiment.

Figure 11:
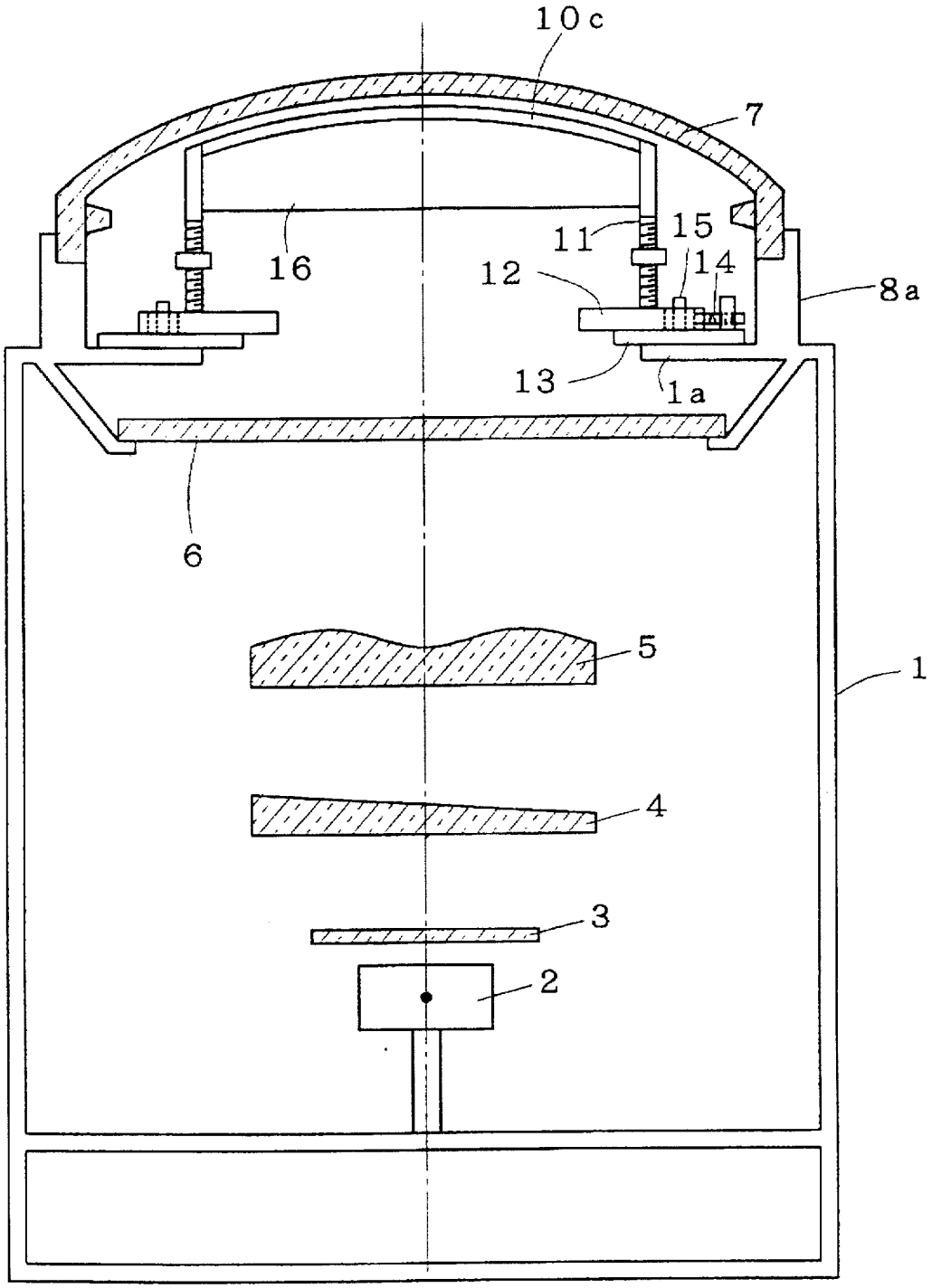
FIG. 11 is a cross-sectional side view of the exposure system according to another aspect of the first preferred embodiment.

The master mask 10 is flat in configuration in the first to third preferred embodiments but may have a predetermined curvature such as a master mask **10*c* shown in FIG. 11. The use of the flat master mask facilitates the formation of stripes or dots for the basic glass panel 7. However, the master mask generally or partially having the predetermined curvature is easily handled to adjust the master mask to the curve of the color selecting mechanism 9**, to use the stripe or dot array difficult to form using the flat master mask, to reduce the spacing between the panel inner surface and the master mask, and to use the glass panel having locally different curvatures.

Figure 12:
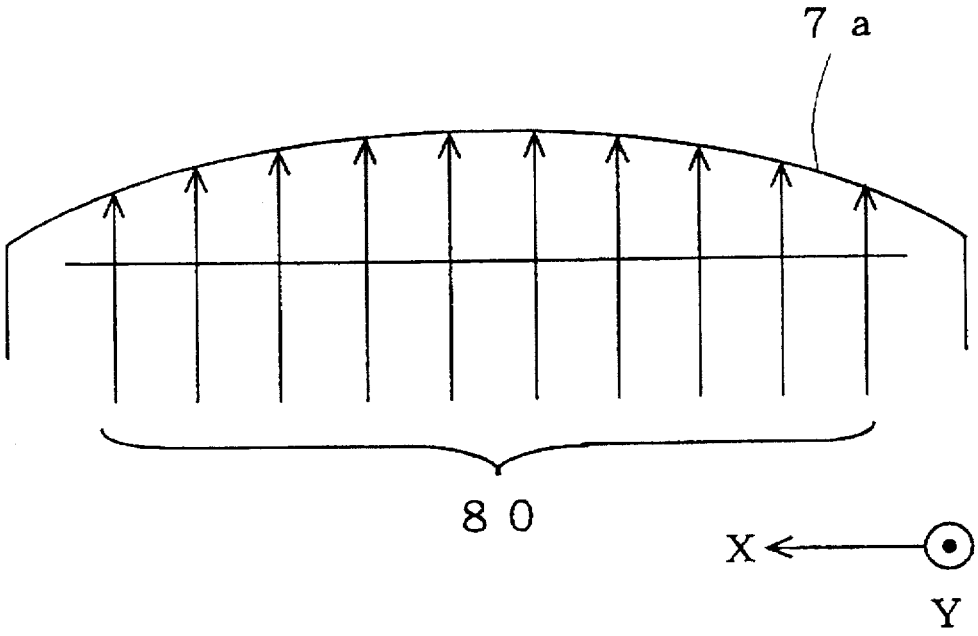
FIG. 12 is a cross-sectional view illustrating the relation between the master mask and the panel when a surface light source is used.

Referring to FIG. 12, the light source may be a surface light source to expose the overall inner surface of the glass panel 7. Since light beams 80 from the surface light source are launched in parallel into the master mask 10, the use of the surface light source facilitates the alignment between the position of the phosphor stripes or dots on the inner surface of the glass panel 7 and the position of the slots or dots of the master mask (having the same X and Y values), insuring the formation of the phosphor stripes or dots in the target position on the inner surface of the glass panel 7.

The black matrix layer is formed in the first to third preferred embodiments. When only the phosphor layers having emitted colors are used without the black matrix layer, the process step of forming the black matrix is eliminated and other process steps are identical with those of the first to third preferred embodiments.

While the invention has been shown and described in detail, the foregoing description is in all aspects illustrative and not restrictive. It is therefore understood that numerous modifications and variations can be devised without departing from the scope of the invention.

What is claimed is:

1. A method of forming a fluorescent screen for a color cathode-ray tube by forming a black matrix, plural phosphor stripes or plural phosphor dots on an inner surface of a panel of the color cathode-ray tube, said method comprising the steps of:

(a) mounting a color selecting mechanism on said panel such that said panel is paired with said color selecting mechanism;

(b) calculating an alignment reference by gathering an image of a reference slot or dot of said color selecting mechanism;

(c) removing said color selecting mechanism from said panel;

(d) mounting said panel without said color selecting mechanism in an exposure system having a position-adjustable master mask;

(e) adjusting a position of said position-adjustable master mask based on said alignment reference; and (f) exposing said panel with said position adjustable master mask so as to form said black matrix, said plural phosphor strips or said plural phosphor dots on said inner surface of said panel.

2. The method of claim 1, wherein said position-adjustable master mask of said exposure system has a curved major surface.

3. The method of claim 1, wherein said position-adjustable master mask of said exposure system has a flat major surface.

4. The method of claim 1, wherein said position-adjustable master mask has a slot or dot array which is determined by a stripe or dot array projected onto said inner surface of said panel and a position of a light source of said exposure system.

5. The method of claim 1, wherein said position-adjustable master mask has a slot or dot array which is determined by a stripe or dot array projected onto said inner surface of said panel through a slot or dot array of said color selecting mechanism and a position of a light source of said exposure system.

6. The method of claim 1, wherein said adjusting step includes an adjustment by moving said position-adjustable master mask in a direction perpendicular to a major surface of said position-adjustable master mask, in a first direction within said major surface of said position-adjustable master mask, in a second direction within said major surface and orthogonal to said first direction, and a rotational direction within said major surface.

7. The method of claim 1, wherein said adjusting step includes an adjustment by moving a light source of said exposure system in a direction perpendicular to a major surface of said position-adjustable master mask, in a first direction parallel to said major surface of said position-adjustable master mask, and in a second direction parallel to said major surface and orthogonal to said first direction.

8. The method of claim 1, wherein said adjusting step includes adjusting by a correction lens of said exposure system for correcting an optical path of an exposure light beam for correction of a beam landing position.

9. The method of claim 1, wherein said position-adjustable master mask includes a black matrix master mask having slots or dots for said black matrix, and wherein said step (f) includes the steps of:

exposing said panel with said black matrix master mask to form said black matrix, and exposing said panel with said black matrix master mask with predetermined portions of said slots or dots closed, to form said plural phosphor stripes or said plural phosphor dots after forming said black matrix.

10. The method of claim 1, wherein a light source of said exposure system includes a surface light source.

11. The method of claim 1, wherein said position-adjustable master mask including a dual-purpose master mask used for forming phosphor layers for a plurality of emitted colors, and wherein said exposing step includes the step of sequentially moving a position of an image projected onto the inner surface of said panel so that the image projected onto said inner surface of said panel through said dual-purpose master mask is in corresponding relation to said phosphor layers for said plurality of emitted colors, and sequentially exposing said panel to form said different phosphor layers wherein each phosphor layer includes a plurality of phosphor dots or a plurality of phosphor stripes.

12. The method of claim 11, wherein said sequentially moving step is performed by sequentially moving a position of a light source of said exposure system.

13. The method of claim 11, wherein said sequentially moving step is performed by sequentially moving said dual-purpose master mask of said exposure system.

14. The method of claim 1, further comprising the steps of:

(g) determining a position of a reference slot or dot of said black matrix by gathering an image of said reference slot or dot of said black matrix;

(h) judging an amount of deviation of said position of said reference slot or dot of said black matrix from said position of said reference slot or dot of said color selecting mechanism based on said alignment reference; and (i) correcting said position of said position-adjustable master mask based on said amount of deviation.

15. A system for forming a fluorescent screen for a color cathode-ray tube by exposing a panel mounted therein to form a black matrix, plural phosphor stripes or plural phosphor dots on said panel of said color cathode-ray tube, said system comprising:

an imaging device for gathering an image of a reference slot or dot of a color selecting mechanism which is paired with said panel, in the condition in which said color selecting mechanism is mounted in said panel, to determine a position of said reference stripe or dot;

an alignment reference calculator for calculating an alignment reference based on said position of said reference stripe or dot determined by said imaging device;

exposure means having a light source for exposure;

a position-adjustable master mask disposed between said light source and said panel in the condition in which said color selecting mechanism is demounted in said panel for projecting a plurality of stripes or a plurality of dots onto an inner surface of said panel; and control means for controlling said position-adjustable master mask based on said alignment reference calculated by said alignment reference calculator.

16. The system of claim 15, wherein said position-adjustable master mask includes a plurality of phosphor layer master masks corresponding to a plurality of emitted colors of phosphor layers.

17. The system of claim 16, wherein said position-adjustable master mask further includes a black matrix master mask corresponding to a black matrix layer.

18. The system of claim 15, wherein said position-adjustable master mask includes a dual-purpose master mask corresponding to a plurality of emitted colors of phosphor layers and a black matrix layer.

19. The system of claim 15, wherein said position-adjustable master mask includes a curved major surface.

20. The system of claim 15, wherein said position-adjustable master mask includes a flat major surface.

21. The system of claim 15, wherein said position-adjustable master mask has a slot or dot array, and said slot or dot array is determined by a stripe or dot array to be projected onto said inner surface of said panel and the position of said light source of said exposure means.

22. The system of claim 15, wherein said position-adjustable master mask has a slot or dot array, and said slot or dot array is determined by a stripe or dot array to be projected onto said inner surface of said panel through a slot or dot array of said color selecting mechanism and a position of said light source of said exposure means.

23. The system of claim 15, further comprising:

first moving means for moving said position-adjustable master mask in a direction perpendicular to a major surface of said position-adjustable master mask;

second moving means for moving said position adjustable master mask in a first direction within said major surface of said position-adjustable master mask;

third moving means for moving said position-adjustable master mask in a second direction within said major surface of said position-adjustable master mask and orthogonal to said first direction; and fourth moving means for rotating said position-adjustable master mask within said major surface.

24. The system of claim 15, further comprising:

first moving means for moving said light source in a direction perpendicular to a major surface of said position-adjustable master mask;

second moving means for moving said light source in a first direction parallel to said major surface of said position-adjustable master mask; and third moving means for moving said light source in a second direction parallel to said major surface of said position-adjustable master mask and orthogonal to said first direction.

25. The system of claim 15, further comprising:

a correction lens disposed between said position-adjustable master mask and said light source for correcting a position of said plurality of stripes or dots to be projected onto the inner surface of said panel through said position-adjustable master mask.

26. The system of claim 15, wherein said light source includes a surface light source.

27. The system of claim 15, wherein said imaging device gathers an image of a reference slot or dot of said black matrix to determine a position of said reference slot or dot of said black matrix, said alignment reference calculator calculates an amount of deviation of said position of said reference slot or dot of said black matrix from said position of said reference slot or dot of said color selecting mechanism based on said alignment reference, and said control means corrects said position-adjustable master mask based on said amount of deviation.

* * * * *